US005772079A

United States Patent [19]

Gueret

[11] Patent Number: 5,772,079

[45] Date of Patent: Jun. 30, 1998

[54] DEVICE FOR PACKAGING AND DISPENSING A LIQUID OR SEMI-LIQUID SUBSTANCE

[75] Inventor: Jean-Louis Gueret, Paris, France

[73] Assignee: L'Oreal, Paris, France

[21] Appl. No.: 645,069

[22] Filed: May 13, 1996

[30] Foreign Application Priority Data

May 17, 1995 [FR] France ..... 95 05845

[51] Int. Cl.[6] ..... B65D 88/54

[52] U.S. Cl. ..... 222/321.7; 222/386.5; 222/256

[58] Field of Search ..... 222/95, 105, 386.5, 222/321.7, 321.9, 207, 212, 256

[56] References Cited

U.S. PATENT DOCUMENTS

| | | | |
|---|---|---|---|
| 3,592,365 | 7/1971 | Schwartzman . | |
| 5,265,765 | 11/1993 | Maier | 222/105 |
| 5,305,921 | 4/1994 | Kock et al. | 222/95 |
| 5,630,531 | 5/1997 | Gaucher | 222/321.9 X |

FOREIGN PATENT DOCUMENTS

| | | |
|---|---|---|
| 1531339 | 7/1968 | France . |
| 2 709 734 | 3/1995 | France . |
| 1586797 | 7/1970 | Germany . |
| 90 13 168 | 1/1992 | Germany . |
| 44 03 755 | 11/1994 | Germany . |

*Primary Examiner*—Gregory L. Huson
*Attorney, Agent, or Firm*—Oliff & Berridge, PLC

[57] ABSTRACT

A device for packaging and dispensing a liquid or semi-liquid substance includes a receptacle suitable for containing the substance. The receptacle has a substance outlet orifice fitted with a pump including a valve suitable for enabling the substance to be delivered without ingress of air. The receptacle also includes a bottom wall constituted by a bag that defines a space inside the receptacle and contains the substance. The bag is capable of moving inside the receptacle in response to the substance being delivered so as to reduce the volume of the space and to ensure that the substance stored inside the receptacle does not come into contact with air. A margin at one end of the bag is fixed to the receptacle and the bag is suitable for deforming so as to reduce the space until the bag coincides substantially with the inside shape of the receptacle. The bag is made of a material that is elastically deformable.

21 Claims, 4 Drawing Sheets

DEVICE FOR PACKAGING AND DISPENSING A LIQUID OR SEMI-LIQUID SUBSTANCE

The present invention relates to devices for packaging and dispensing a substance that is liquid or semi-liquid.

BACKGROUND OF THE INVENTION

Devices have been proposed that comprise a receptacle having a cylindrical body in which a piston can slide. Inside the receptacle, the piston defines a space of variable volume for containing the substance. The receptacle is provided with a pump for extracting substance from said space. The piston moves inside the receptacle in response to substance being delivered when the pump is actuated, thereby ensuring that the substance stored inside the receptacle does not come into contact with air. An advantage of devices of that type is that they can be used equally well head-up or head-down. However, the use of a moving piston gives rise to leakage problems, particularly if the substance is a liquid, so the use of such known devices has been restricted to packaging and dispensing viscous substance such as toothpaste.

German utility model G 90 13 168.1 discloses a device for packaging and dispensing a liquid or semi-liquid substance that comprises a receptacle suitable for containing said substance, the receptacle having a substance outlet orifice fitted with a pump that includes a valve suitable for enabling the substance to be delivered without allowing ingress of air, the receptacle also including a bottom wall constituted by a bag defining a space inside the receptacle and containing said substance, said bag being capable of moving inside the receptacle in response to the substance being delivered so as to reduce the volume of said space while preventing the substance still inside the receptacle from coming into contact with air. The margin at one end of the bag is fixed to the receptacle, and the bag is suitable for deforming so as to reduce the volume of said space until it fits substantially over the inside shape of the receptacle. The bag is folded up when the receptacle is full of substance and it is deployed progressively as the substance is dispensed. The bag is held captive inside the receptacle by a rigid wall pierced with an orifice that enables air to penetrate into the receptacle on the side of the bag which faces away from the substance. The device described in that German utility model is used with a pump at the bottom and it is unsuitable for use with a pump on top since, under such circumstances, there would be a risk of the substance being retained in a cavity formed by folds in the bag and thus preventing the substance from being dispensed by the pump. In addition, the bag runs the risk of covering the orifice which allows air to enter into the receptacle, and that would prevent the device from operating properly.

German patent application DE 1 586 797 discloses a device for packaging and dispensing a liquid or semi-liquid substance, which device comprises a receptacle having a deformable wall suitable for containing said substance, the receptacle having an outlet orifice fitted with a valve suitable for enabling substance to be delivered without allowing ingress of air, the receptacle also comprising a bag defining a space inside the receptacle and containing said substance, said bag being capable of moving inside the receptacle in response to substance being delivered to reduce the volume of said space and to ensure that said substance stored inside the receptacle does not come into contact with air, the bag having its margin at one end fixed to the receptacle and being suitable for expanding to reduce the volume of said space.

As substance is delivered from the receptacle, the bag fills with air through an orifice in the receptacle, which orifice is fitted with a valve to prevent air from leaving the bag when the walls of the receptacle are squeezed to expel the substance. Since the bag is elastically deformable, it contains air which is in a compressed state. When the bag occupies the majority of the volume inside the receptacle, the pressure exerted on the walls of the receptacle tends to compress the air contained in the bag, causing the bag to expand by a small amount only, so it becomes difficult to dispense the substance. Thus, that device does not make it easy to use up all of the substance contained inside the receptacle.

OBJECTS AND SUMMARY OF THE INVENTION

The present invention seeks to provide a novel device for packaging and dispensing a liquid or semi-liquid substance, the device being of the type comprising a receptacle suitable for containing said substance, the receptacle having a substance outlet orifice fitted with a pump including a valve suitable for enabling substance to be delivered without allowing ingress of air, the receptacle also including a bottom wall constituted by a bag that defines a space inside the receptacle and containing said substance, said bag being capable of moving inside the receptacle in response to the substance being delivered, so as to reduce the volume of said space and to ensure that the substance stored inside the receptacle does not come into contact with air, a margin at one end of said bag being fixed to the receptacle and the bag being suitable for deforming so as to reduce the volume of said space until the bag coincides substantially with the inside shape of the receptacle, the device also being capable of being used with the pump on top or underneath, and enabling nearly all of the substance contained inside the receptacle to be dispensed.

This is achieved by the fact that said bag is made of a material that is elastically deformable.

When the substance leaves the receptacle, the suction established in said space by the substance being delivered causes the bag to deform in the direction that tends to reduce the volume of said space, with this continuing until the suction has been eliminated.

Because of its elasticity, the bag in its maximally-expanded state advantageously occupies nearly all of the volume initially occupied by the substance, and this applies regardless of the shape of the receptacle. The invention thus makes it possible to use a wide variety of shapes for the receptacle, whereas prior art devices having a moving piston necessarily have a body that is cylindrical.

In a preferred embodiment of the invention, the pump is situated, in use, at the top of the receptacle.

In a particular embodiment of the invention, the bag is suitable for deploying initially without its wall being subjected to tension, and then subsequently for expanding elastically.

Thus, said bag can deploy initially without its wall being subjected to tension so as to occupy more than half of the space initially occupied by the substance, and then subsequently the bag is suitable for expanding elastically to occupy the remaining space released by the substance.

Because the bag is suitable for expanding elastically after the receptacle has been emptied to a certain degree, it has fewer folds when the receptacle is full than do the bags of known devices which are not made out of elastic material; as a result the risks associated with the air inlet orifice being obstructed are reduced.

Advantageously, the bag is provided on the inside with a lining of material that is not elastically deformable but that is highly impervious to gas, said lining being suitable for deploying to accompany deformation of the bag until the wall of the bag comes under tension.

In another particular embodiment of the invention, the bag is perceptibly under tension when the receptacle is full.

Thus, when the receptacle is full, the bag may be in the form of an elastic membrane that is substantially plane. The receptacle can be substantially flat and shaped so that when empty, the bag has moved through a relatively small height, e.g. lying in the range 15 mm to 20 mm.

In a particular embodiment of the invention, the device includes closure means suitable for isolating the inside of the bag from ambient air, at least prior to first use of the device. In association with the bag, such closure means constitute a double sealing barrier that enhances long-term conservation of the substance contained in the receptacle. In addition, when the closure means are in place on the receptacle, they prevent the bag from inflating due to ingress of air and they prevent the pump being used to deliver any substance. The closure means thus serve advantageously as a tamperproofing seal, insofar as intact closure means present on the device inform the user that the device has not been previously used in normal manner.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 2:
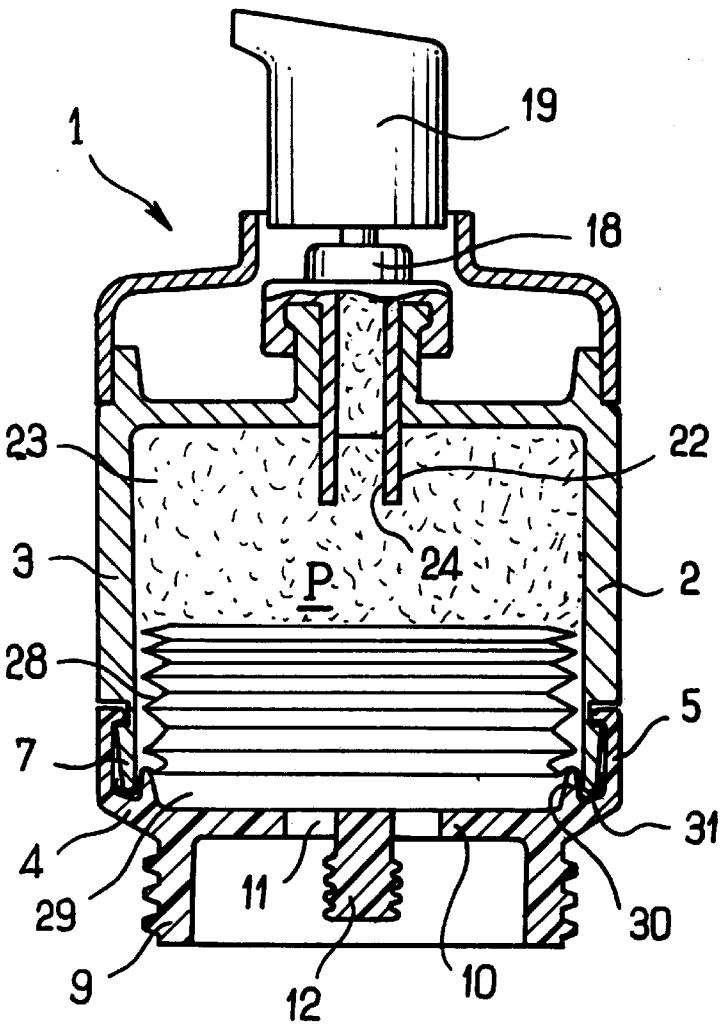
FIG. 2 shows the FIG. 1 device while in use.
Figure 1:
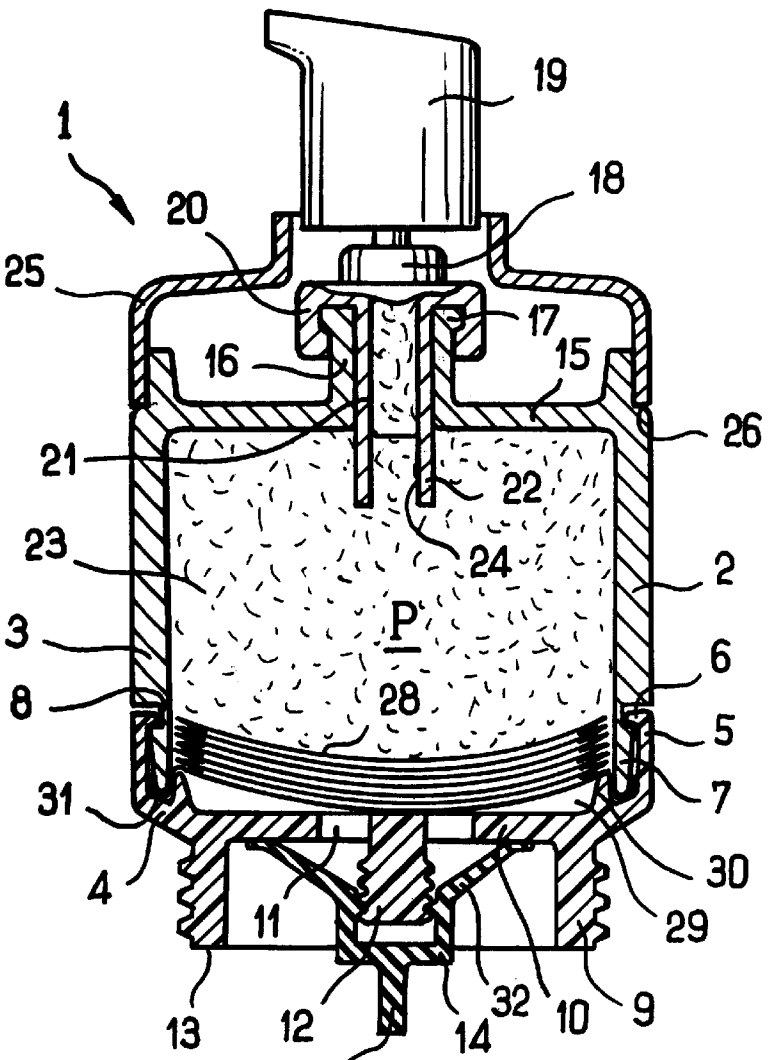
FIG. 1 shows a packaging and dispensing device constituting a first embodiment of the invention, before first use.

FIGS. 1 and 2 show a device 1 of the invention for packaging and dispensing a liquid or semi-liquid cosmetic substance P. Naturally, it would not go beyond the ambit of the invention to use the device to package and dispense a substance other than a cosmetic.

The device 1 comprises a rigid-walled receptacle 2 that is generally circularly symmetrical in the example described, and that is assembled by snap-fastening a body 3 on a base 4. The base has a top tubular skirt 5 having a rim 6 projecting radially inwards from its free edge. The body 3 is provided with a bottom tubular wall 7 of outside diameter adapted to engage in the tubular wall 5. The tubular wall 7 joins the remainder of the body 3 via a portion of narrow section 8 that defines an outside angular groove in which the rim 6 engages when the body 3 is snapped to the base 4. The base includes a bottom tubular skirt 9 with an outside thread for screw engagement in a base that is known per se and not shown. A plane wall 10 perpendicular to the axis of symmetry of the receptacle 2 extends radially inwards at the junction between the top and bottom tubular skirts 5 and 9. This wall 10 has openings 11 passing through it in a central annular region. A central fixing stud 12 secured to the wall 10 extends along the axis of symmetry of the receptacle 2 inside the threaded tubular portion 9. The fixing stud 12 serves for retaining removable closure means 14 as described below.

The top portion of the body 3 is closed by a wall 15 having an upwardly-extending neck 16 provided at its top end with a radially-outwardly-projecting annular rim 17. A pump 18 that is known per se and not described is fixed to the neck 16. The pump 18 includes a substance-dispensing pushbutton 19 and it is provided at its bottom with a cap 20 shaped to snap onto the annular rim 17 of the neck 16. The pump 18 has a tube 21 for taking substance P from the receptacle 2. The tube 21 is engaged in the opening of the neck 16 and its bottom end extends beneath the wall 15 in an inside space 23 of the receptacle 2 containing the substance P. Two lateral openings 24 having a function that is explained below are provided through the bottom end 22 of the tube 21.

A cover 25 covers the neck 16 of the body 3. The cover 25 engages on the body 3 as shown in FIGS. 1 and 2 until its bottom edge comes into abutment against a shoulder 26 formed on the outside surface of the body 3, and on top and in the middle it is provided with a passage for the pushbutton 19.

The device 1 includes a bag 28 having a certain amount of elasticity and, in the example described, being in the form of a bellows in the folded state defining two spaces inside the receptacle 2, one of which spaces is constituted by the above-mentioned inside space 23 containing the substance P, while the other space is inside the bellows and is referenced 29. The bag 28 constitutes a deformable leak-proof barrier separating the spaces 23 and 29. The inside space 29 communicates via the openings 11 with the outside once the closure means 14 have been removed, as shown in FIG. 2.

The bottom end of the bag 28 is fixed around its periphery to the receptacle 2 so that the inside of the bellows communicates with ambient air via the openings 11. More precisely, the bottom margin of the wall 28 is clamped between the tubular skirts 5 and 7 of the base 4 and of the body 3, respectively. Preferably, and as shown, the base 4 includes an annular lip 30 coaxial with the tubular skirt 5 and co-operating therewith to define an annular groove 31 in which the bottom end of the tubular skirt 7 of the body 3 engages. The annular lip 30 improves the strength and the sealing of the fixing between the bag 28 and the receptacle 2 by clamping the bag against the radially inner surface of the tubular skirt 7. The wall of the bag 28 where it is clamped between the body 3 and the base 4 constitutes a sealing ring that enables the body 3 to be assembled hermetically on the base 4. Naturally, it would not go beyond the ambit of the present invention for the margin of the bottom end of the bag 28 to be fixed to the body 3 only or to the base 4 only, e.g. by heat sealing.

The above-mentioned closure means 14 in the example described are in the form of a cap or suction cup including a central recess held by friction on the fixing stud 12. The wall that defines said recess radially is extended upwardly by a sealing lip 32 which extends obliquely and radially outwardly so as to press its free end against the wall 10 around the openings 11 when the cap 14 is in place. As shown, the bottom end of the cap is advantageously provided with a tongue 33 to facilitate removal thereof.

Advantageously, prior to the cap 14 being put into place, a vacuum is established in the inside space 29 by sucking air out through the openings 11 by means of an appropriate device so as to cause the bag 28 to fold up, as shown in FIG. 1. The bag 28 then occupies a small volume inside the receptacle 2.

In the example described, the bag 28 is folded up by suction through the openings 11 before the pump 18 and the cover 25 have been put into place on the receptacle 2. Once the bag 28 is folded up, the receptacle 2 is filled with substance under vacuum through the neck 16, and then the pump 18 is snapped onto the neck and the cover 25 is put on. In a variant, the bag 28 is secured to the base 4 only. The receptacle 2 is filled before the base 4 is assembled thereto with the bag 28 in the folded state. Filling is then performed via the bottom, with the pump 18 already in place on the body 3. After filling, the base 4 fitted with the bag 28 held in the folded-up state by the cap 14 is snapped onto the body 3.

The pump 18 includes a valve organized in conventional manner to enable substance P to be extracted from the receptacle via the tube 21 without any air penetrating therein. If the user attempts to extract substance P by pressing on the pushbutton 19 while the cap 14 is still in place, then the pump cannot operate properly to dispense the substance. In contrast, once the cap 14 has been removed, the bag 28 can inflate within the receptacle 2 so as to reduce the volume of the inside space 23 so that no suction can be established therein to prevent substance being taken therefrom. As the substance is used up, the bag 28 extends upwards along the axis of symmetry of the receptacle 2, as shown in FIG. 2. The bag 28 can inflate because air enters the bag through the openings 11 to occupy all of the volume inside the receptacle 2 that is released by the substance P.

The bag 28 is made of an elastically deformable material such as rubber or a thermoplastic elastomer. It is possible to use a blow-molding technique, an injection molding technique, or a dip molding technique, in particular. The bag 28 may also be constituted by assembling together at least two layers of different plastics materials. The bag 28 may also be of varying thickness so as to facilitate expansion in selected zones of the bag.

In the example described, the bag 28 may be deployed to occupy up to about 80% of the volume initially occupied by the substance P before the wall of the bag begins to be put under tension. Thereafter, because of its elasticity, the wall of the bag can be extended further as to fit over the shape of the inside of the receptacle and occupy the remaining 20% of the initial volume.

Given that the bag 28 is fixed to the receptacle via a margin at its bottom end, when it deforms elastically, it begins by pressing against the wall of the receptacle 2 adjacent to the base 4. Thereafter, by pressing itself progressively against the wall of the receptacle starting from the bottom and moving upwards, the bag 28 ensures that all of the substance P is raised towards the outlet tube 21.

The above-mentioned lateral openings 24 formed through the bottom portion of the tube 21 of the pump 18 serve to enable substance P to penetrate into the tube 21 laterally, thereby enabling the device to operate even after the bag 28 has begun to press against the bottom end edge of the tube 21.

In a variant embodiment (not shown), the bag 28 is provided on the inside with a lining of material that is not elastically deformable but that is very highly impermeable to gases, e.g. polyethylene. The inside of the lining communicates with ambient air via the openings 11 and the lining can be inflated to occupy up to about 80% of the volume initially occupied by the substance. Once the wall of the lining is under tension, the bag continues to deform because of its own elasticity to occupy the remaining 20% of the initial volume, with reduced pressure appearing in the gap between the bag and its lining.

Figure 4:
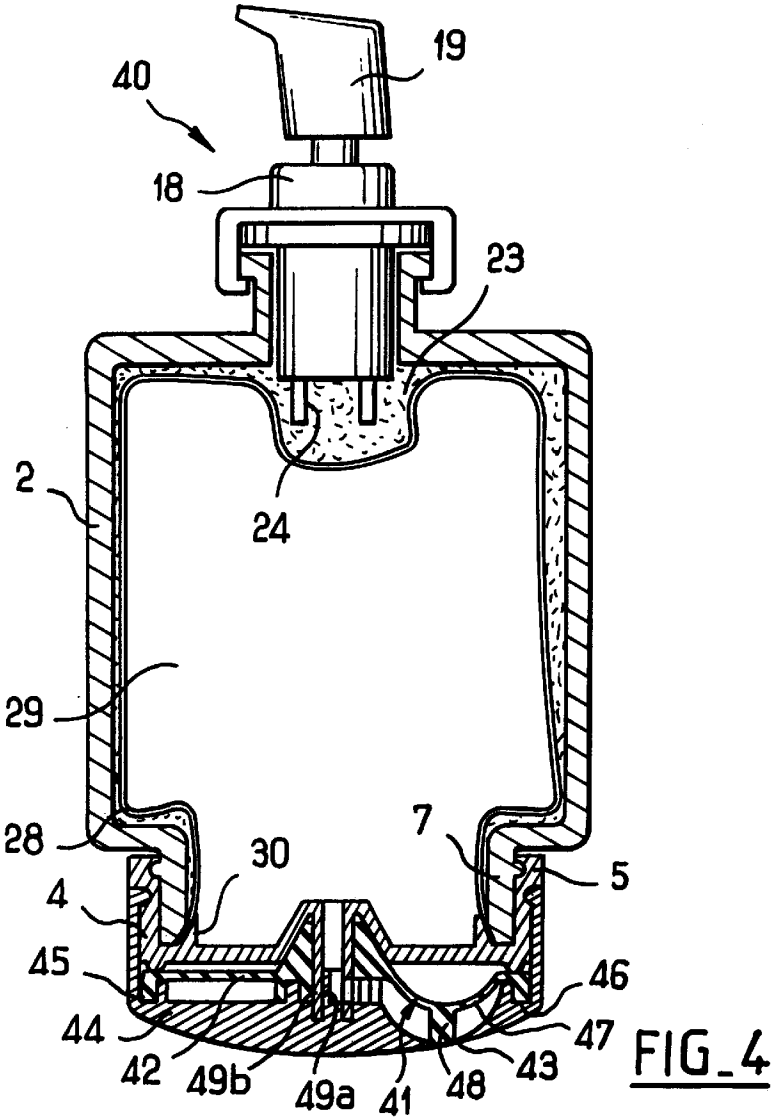
FIG. 4 shows the FIG. 3 device at the end of use.
Figure 3:
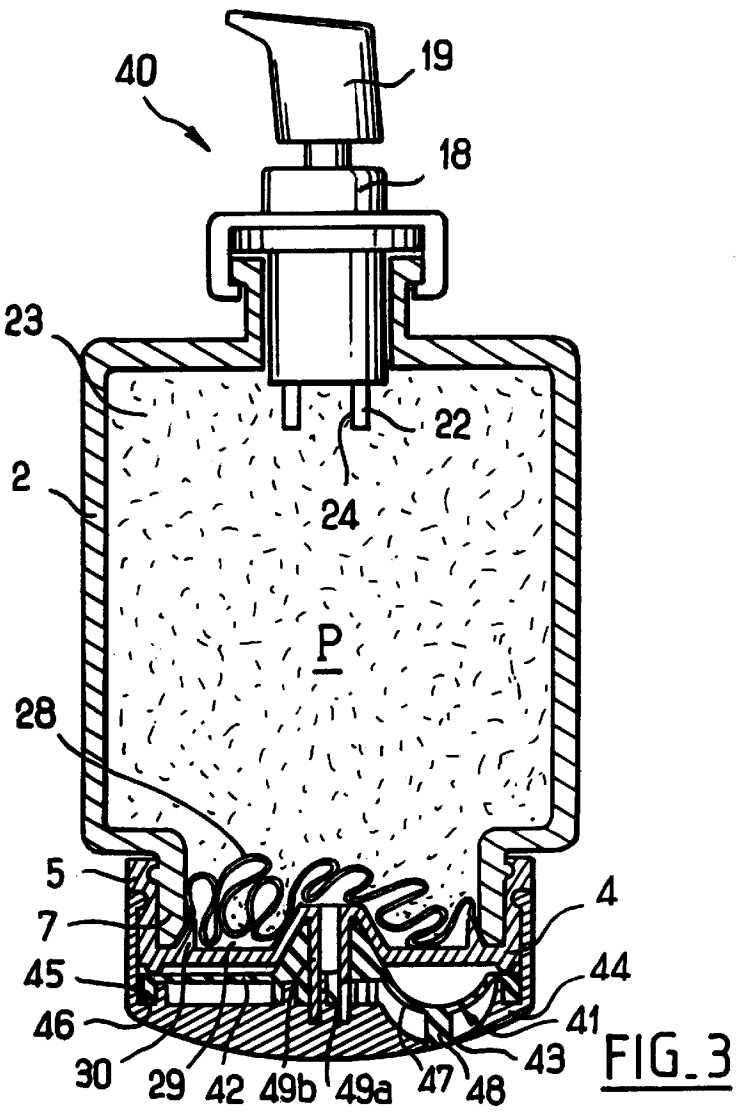
FIG. 3 shows a second embodiment of a device of the invention, before first use.

FIGS. 3 and 4 show a device 40 constituting a second embodiment of the invention.

In the description below, identical reference symbols are used for certain elements that are functionally analogous to those described above, and they are not described again.

The device 40 differs from the preceding device mainly in that a valve 41 is disposed in the air passage putting the inside space 29 into communication with the outside. This valve 41 is such as to enable air to penetrate into the inside space 29 while preventing air from escaping therefrom to the outside. The valve 41 opens only while air is penetrating into the bag 28 as the bag itself is expanding, and in the rest state it co-operates therewith to form a second sealing barrier, thereby enhancing long-term conservation of the substance contained in the receptacle. As in the above embodiment, the bag 28 may inflate until its wall is under tension, after which it may deform elastically so as to occupy substantially all of the volume initially occupied by the substance P to be dispensed (as shown in FIG. 4). The valve 41 comprises a membrane 42 having its periphery pressed against the base 4 and suitable for deforming elastically so as to release an orifice 43 for passing air into the inside space 29. The membrane 42 is pressed against the base 4 by means of a cock-forming retaining piece 44 snapped onto the base 4 and capable of being rotated about the axis of symmetry of the receptacle 2. The periphery of the membrane 42 has an annular rim 45 engaged in an annular groove 46 in the retaining piece 44. The base 4 is provided on its bottom face with an annular bead that clamps the membrane 42 to the base of the rim 45 so as to keep the membrane 42 sealed at its periphery. The membrane 42 has a hemispherically-shaped portion 47 with its concave side facing upwards, and extended downwards by means of a closure finger 48 suitable for pressing against the edges of the above-mentioned orifice 43 formed through the retaining piece 44. The membrane 42 is shaped in such a manner that this hemispherical portion 47 is slightly pre-stressed at rest and urges the closure finger 48 resiliently against the edges of the orifice 43 to close it. Thus, so long as the device 40 is not in use, the valve is in its position for closing the passage that otherwise enables the inside space 29 to communicate with the outside.

The base 4 and the retaining piece 44 together constitute a cock which, when the retaining piece 4 is in a determined angular position, closes the passage that otherwise enables the orifice 43 to communicate with the inside space 29. The retaining piece 44 has a portion that forms a plug 49*a* engaged in a bottom tubular extension 49*b* from the base 4.

For storage, the retaining piece 44 is turned so as to close the air passage between the plug 49*a* and the tubular portion 49*b*. The inside 29 of the bag 28 is thus isolated from the outside for good conservation of the substance. A tearable foil may be fixed on the outside covering two adjacent surfaces on the base 4 and on the retaining piece 44 so as to act as a tamperproofing mark. So long as the foil is intact, the user knows that the inside of the bag 28 has remained isolated from the outside and that normal operation of the pump 18 has not been possible.

Figure 5:
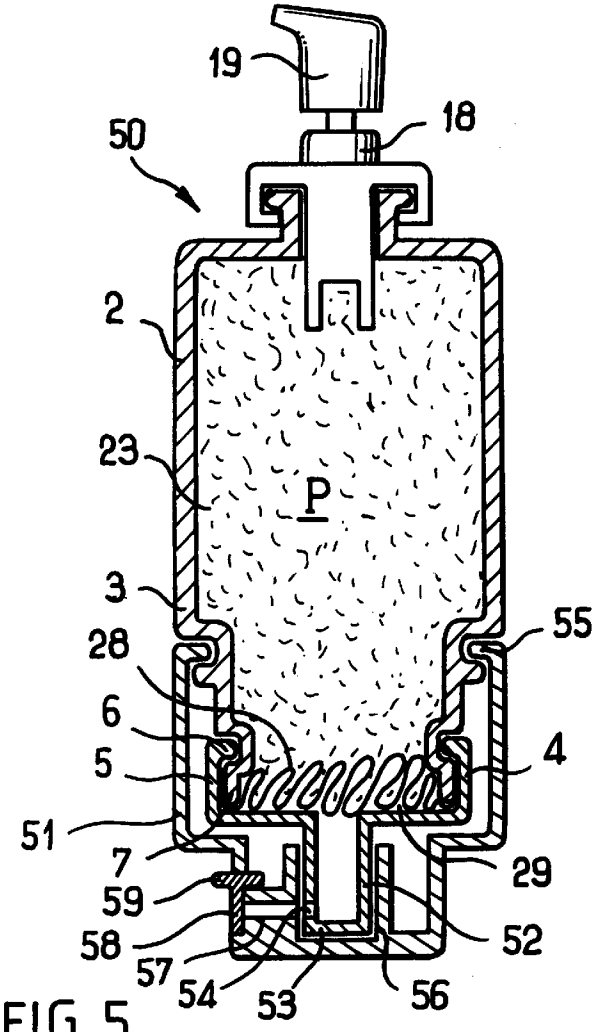
FIG. 5 shows a third embodiment of a device of the invention, before first use.

FIG. 5 shows a device 50 constituting a third embodiment of the invention. This device includes a cock 51 capable of taking up two angular positions. In a first angular position, the cock 51 can allow air to pass between the inside space 29 and the outside, and in a second angular position, the cock isolates the inside space 29 from the outside. In the example described, the bottom portion of the base 4 has a tubular wall 52 which is closed at its bottom end 53 and which has a radial hole 54 passing therethrough. The cock 51 is snapped onto the body 3 of the receptacle 2 at 55 in such a manner as to be free to rotate about the axis of symmetry thereof. It has a recess 56 that fits closely over the tubular wall 52 of the base 4. A radially extending through hole 57 has its radially inner end opening out into the recess 56 and, when the cock 51 is in said second angular position, is capable of coming into register with the hole 54 to establish a passage for air therewith and with the inside space 29. As shown in FIG. 5, the cock 51 is provided with a membrane 58 suitable for closing the hole 57 after first use of the device. This membrane 58 is fixed in removable manner on the cock 51 and has a tab portion 59 enabling the user to remove it on first use of the device. The bag 28 is folded up by evacuating the inside space 29. The membrane 58 advantageously acts as a valve when it is on the cock 51, deforming to allow air to pass outwards while the inside space 29 is being evacuated, and preventing air from returning in the opposite direction.

The device 50 operates as follows. On first use, the user positions the hole 57 of the cock 51 in register with the hole 54 in the base 4 and tears off the membrane 58. Removal of the membrane 58 enables air to penetrate into the inside space 29. When the pushbutton 19 of the pump 18 is actuated, substance P is removed from the inside space 23 and the bag 28 deforms to compensate the reduction in volume caused by removal of the substance P. After use, in order firstly to prevent substance P escaping in the event of involuntary action on the pushbutton 19, and secondly to improve conservation of the substance P, the user can close the hole 54 by turning the cock 51. The inside space 29 is then isolated from the outside.

Figure 6:
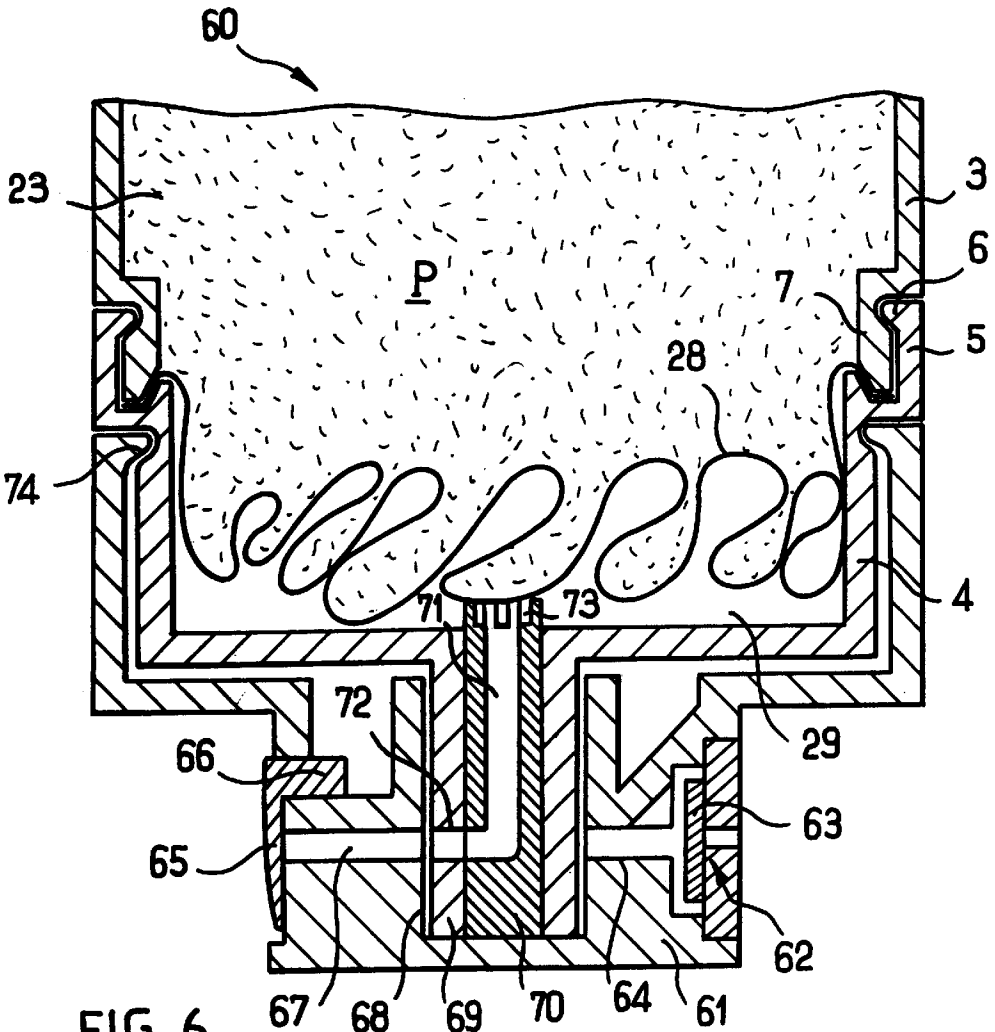
FIG. 6 shows a fourth embodiment of a device of the invention, before first use.

FIG. 6 shows a fragment of a fourth embodiment of a device 60 of the invention. The device 60 includes a cock 61 fitted with a first valve 62 which acts, when the cock 61 is in a first angular position, to allow air to penetrate into the inside space 29 while preventing air from escaping therefrom. The valve 62 used may be of any type that is known per se and it is shown diagrammatically, only. It includes a shutter 63 suitable for moving inside the cock 61 between a position in which it closes a passage 64 putting the outside into communication with the inside space 29, and a position that allows air to flow through said passage 64 into the inside space 29. The cock 61 is fitted with a second valve 65 that acts, in a second angular position of the cock 61, to allow air to escape from the inside space 29 while preventing air from returning therein. In the example described, the valve 65 is constituted by a membrane that includes a fixing portion 66 secured to the cock 61. In the closure position, the valve 65 closes a channel 67 that extends radially through the cock 61 and that has its radially inner end opening out into a recess 68 in which a tubular portion 69 of the base 4 is engaged. An endpiece 70 is fixed in the tubular portion 69. This endpiece 70 has a channel 71 running therealong with its top end opening out into the inside space 29 and with its bottom end opening out to the outside of the tubular portion 69 via a hole 72 passing through the wall thereof. In the above-mentioned second angular position of the cock 61, the position shown in FIG. 6, the channel 67 is in register with the hole 72. The endpiece 70 has a crenellated top end defining lateral openings 73 that enable air to be sucked out from the inside space 29 without running the danger of the channel 71 being closed by the bag 28. The cock 61 is snapped onto the base 4 at 74.

To fold up the bag 28, the cock 61 is positioned in said above-mentioned second angular position and a vacuum is established in the inside space 29 by suction through the channels 67 and 71. While suction is taking place, the valve 65 opens and allows air to escape. Once a vacuum has been established in the inside space 29, the valve 65 closes and prevents air from penetrating into said space. For storage, after the receptacle has been filled, the cock can be turned to occupy an intermediate position between the two above-mentioned angular positions, and in which the hole 72 is closed by the wall of the recess 68 of the cock 61. On first use, the cock 61 is rotated to bring the passage 64 into register with the hole 72. The valve 62 can open to allow to air to penetrate into the inside space 29. The cock 61 is kept in this angular position while the device is in use. It can be turned again to isolate the inside space 29 e.g. while the device is being transported or if it is to be stored for a long period of time without being used.

Naturally, numerous modifications may be applied to the above-described devices without going beyond the ambit of the present invention. In particular, the pump can be installed in removable manner on the receptacle so as to enable refills of substance to be used.

Figure 7:
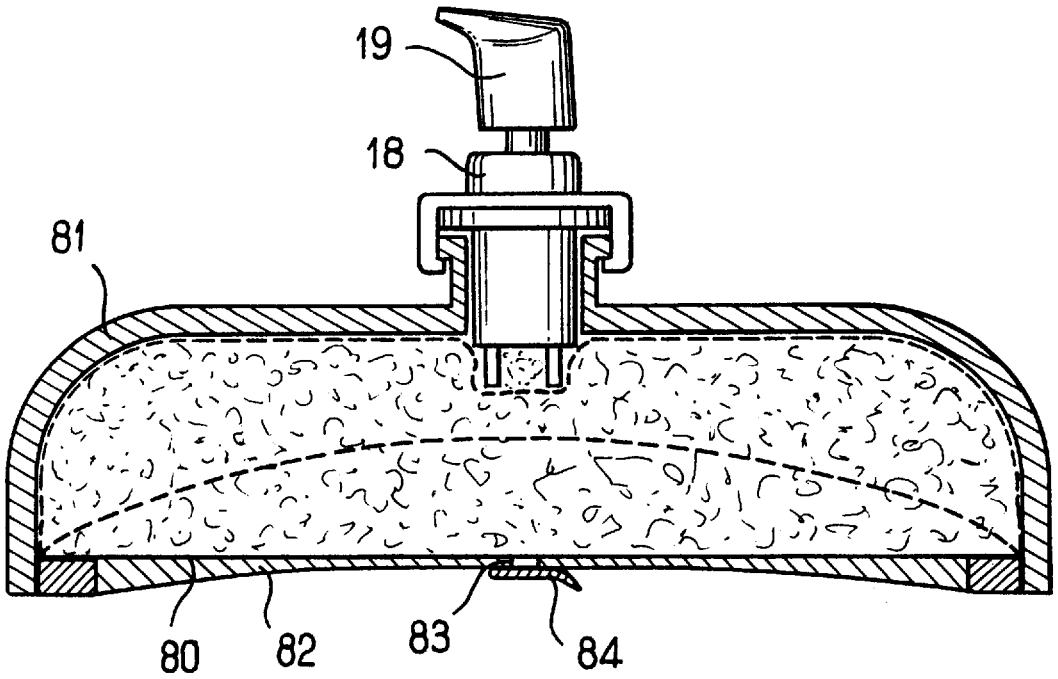
FIG. 7 shows a fifth embodiment of the invention.

As shown in FIG. 7, the bag may be in the form of a resilient membrane 80 having its margin fixed to the wall of the receptacle, which membrane is initially flat or slightly concave or convex relative to the substance, and is suitable for deforming elastically over a height of 15 mm to 20 mm, for example, so as to fit closely over the inside of the receptacle in response to substance being removed.

The invention thus makes it possible to package a substance in a receptacle 81 that is relatively flat, having rigid walls, and fitted on top with a pump 81 provided with a pushbutton 19.

Dashed lines in FIG. 7 show positions occupied by the bag when the receptacle is empty, and also in an intermediate position.

The bag is perceptibly under tension when the receptacle is full and there is no need to close the bottom portion of the receptacle by means of a rigid wall for the purpose of retaining the bag inside the receptacle.

However, FIG. 7 does show a wall 82 closing the bottom end of the receptacle and pierced by an orifice 83 which is closed before use by a peel-off film 84. The wall 82 and the peel-off film 84 enable the bag 80 to be isolated from ambient air before use, for better conservation of the substance. Prior to use, the peel-off film 84 is removed. In a variant, the peel-off film could be replaced by a snap-off peg.

It is also possible, because of the tension in the bag, to package the substance under a certain amount of pressure when the receptacle is full, thereby making it easier to prime the pump.

The thickness of the bag may vary so as to have some zones that deform more easily than others, thereby privileging one or more directions of deformation.

I claim:

1. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing ingress of air, the receptacle also including a bottom wall constituted by a bag that defines a space inside the receptacle containing said substance, said bag being capable of moving inside the receptacle in response to the substance being delivered, so as to reduce the volume of said space and to ensure that the substance stored inside the receptacle does not come into contact with air, a margin at one end of said bag being fixed to the receptacle and the bag being suitable for deforming so as to reduce the volume of said space until the bag coincides substantially with the inside shape of the receptacle, wherein said bag comprising a wall that is elastically deformable.

2. A device according to claim 1, wherein the pump is situated, in use, at the top of the receptacle.

3. A device according to claim 1, wherein the bag is suitable for deploying initially without its wall being subjected to tension, and then subsequently for expanding elastically.

4. A device according to claim 3, wherein said bag is suitable for deploying initially without its wall being subjected to tension so as to occupy more than half of the space initially occupied by the substance, and then subsequently the bag is suitable for expanding elastically to occupy the remaining space released by the substance.

5. A device according to claim 4, wherein the bag is provided on the inside with a lining of material that is not elastically deformable but that is highly impervious to gas, said lining being suitable for deploying to accompany deformation of the bag until the wall of the bag comes under tension.

6. A device according to claim 1, wherein the bag is perceptibly under tension when the receptacle is full.

7. A device according to claim 6, wherein the bag is in the form of a substantially plane membrane.

8. A device according to claim 7, wherein the receptacle is shaped so that then it is empty, the bag has moved through a height of 15 mm to 20 mm.

9. A device according to claim 1, including a removable membrane suitable for isolating the inside of the bag from ambient air, at least prior to first use of the device.

10. A device according to claim 1, including a valve disposed in a vent causing the inside of the bag to communicate with the outside, said valve being shaped to allow air to penetrate into the bag and to prevent air from escaping to the outside.

11. A device according to claim 1, wherein said bag is folded up prior to use of the device by sucking out the air contained inside the bag.

12. A device according to claim 11, wherein, in a folded-up state, said bag is in the form of a bellows.

13. A device according to claim 1, including a cock suitable for isolating an inside of the bag from ambient air, at least prior to the first use of the device, said cock having at least two positions, organized so that in one of the positions, the cock prevents air penetrating into the bag and in the other position, the cock enables air to penetrate into the bag.

14. A device according to claim 13, wherein said cock is fitted with an air inlet valve serving, in a first position of the cock, to allow air to penetrate into the bag, while preventing air from escaping therefrom, and an air outlet valve serving in a second position of the cock, to allow air to escape from the bag and to prevent air from entering therein.

15. A device according to claim 1, wherein said bag is secured to a base for snap-fastening on the body of the receptacle.

16. A device according to claim 1, wherein said bag is of varying thickness so as to have some zones that are more easily deformed than others, for the purpose of privileging one or more directions of deformation.

17. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing an ingress of air, the receptacle also including a bottom wall constituted by a bag that defines a space inside the receptacle containing said substance, said bag being capable of moving inside the receptacle in response to the substance being delivered, so as to reduce the volume of said space and to ensure the substance stored inside the receptacle does not come into contact with air, a margin at one end of said bag being fixed to the receptacle and the bag being suitable for deforming so as to reduce the volume of said space until the bag coincides substantially with the inside shape of the receptacle, wherein said bag comprises a wall that is made of a material that is elastically deformable, wherein said bag is suitable for deploying initially without the wall being subjected to tension so as to occupy more than half of the space initially occupied by the substance, and then subsequently the bag is suitable for expanding elastically to occupy the remaining space released by the substance and wherein the bag is provided on the inside with a lining of material that is not elastically deformable but that is highly impervious to gas, said lining being suitable for deploying to accompany deformation of the bag until the wall of the bag comes under tension.

18. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing an ingress of air, the receptacle also including a bottom wall constituted by a bag that defines a space inside the receptacle containing said substance, said bag being capable of moving inside the receptacle in response to the substance being delivered, so as to reduce the volume of said space and to ensure that the substance stored inside the receptacle does not come into contact with air, a margin at one end of said bag being fixed to the receptacle and the bag being suitable for deforming so as to reduce the volume of said space until the bag coincides substantially with the inside shape of the receptacle, wherein said bag comprises a wall that is made of material that is elastically deformable, said device including a cock suitable for isolating the inside of the bag from ambient air, at least prior to the first use of the device, said cock having at least two positions, organized so that in one of the positions, the cock prevents air from penetrating into the bag and in the other position, the cock enables air to penetrate into the bag, wherein said cock is fitted with an air inlet valve serving, in a first position of the cock, to allow air to penetrate into the bag, while preventing air from escaping therefrom, and an air outlet valve serving in a second position of the cock, to allow to air to escape from the bag and to prevent air from entering therein.

19. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing an ingress of air, the receptacle also including a bottom wall constituted by a bag that defines a space inside the receptacle containing said substance, said bag being capable of moving inside the receptacle in response to the substance being delivered, so as to reduce the volume of said space and to ensure that the substance stored inside the receptacle does not come into contact with air, a margin at one end of said bag being fixed to the receptacle and the bag being suitable for deforming so as to reduce the volume of said space until the bag coincides substantially with the inside shape of the receptacle, wherein said bag comprises a wall made of a material that is elastically deformable, wherein the bag is folded and suitable for deploying initially without the wall being subjected to tension, and then subsequently for expanding elastically.

20. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing an ingress of air, the receptacle also including a bottom wall constituted by a bag that defines a space inside the receptacle containing said substance, said bag being capable of moving inside the receptacle in response to the substance being delivered, so as to reduce the volume of said space and to ensure that the substance stored inside the receptacle containing said substance does not come into contact with air, a margin at one end of said bag being fixed to the receptacle and the bag being suitable for deforming so as to reduce the volume of said space until the bag coincides substantially with the inside shape of the receptacle, wherein said bag comprises a wall made of a material that is elastically deformable, wherein the device further includes a removable membrane suitable for isolating the inside of the bag from ambient air, prior to first use of the device.

21. A device for packaging and dispensing a liquid or semi-liquid substance, the device comprising a receptacle suitable for containing said substance, the receptacle having a substance outlet orifice fitted with a pump including a valve suitable for enabling substance to be delivered without allowing an ingress of air, the receptacle also including a bottom wall constituted by a bag that defines a space inside the receptacle containing said substance, said bag being capable of moving inside the receptacle in response to the substance being delivered, so as to reduce the volume of said space and to ensure the substance stored inside the receptacle does not come into contact with air, a margin at one end of said bag being fixed to the receptacle and the bag being suitable for deforming so as to reduce the volume of said space until the bag coincides substantially with the inside shape of the receptacle, wherein said bag comprises a wall made of material that is elastically deformable, wherein the bag is communicating with ambient air after first use of the device.

* * * * *